United States Patent [19]

Cordani et al.

[11] 4,315,465

[45] Feb. 16, 1982

[54] CONSTANT CONTACT SIDE BEARING FOR ARTICULATED RAIL CARS

[75] Inventors: Eugene J. Cordani, St. Louis; Frederick E. Vorwerk, St. Peters, both of Mo.

[73] Assignee: ACF Industries, Incorporated, New York, N.Y.

[21] Appl. No.: 153,470

[22] Filed: May 27, 1980

Related U.S. Application Data

[63] Continuation-in-part of Ser. No. 929,576, Jul. 31, 1978, abandoned.

[51] Int. Cl.[3] ..... B61F 3/08; B61F 5/14

[52] U.S. Cl. ..... 105/4 R; 105/199 R; 105/199 CB

[58] Field of Search ..... 105/199 CB, 3, 4 R, 105/199 R, 199 C, 238, 244, 207

[56] References Cited

U.S. PATENT DOCUMENTS

| | | | |
|---|---|---|---|
| 1,599,474 | 9/1926 | Koch | 105/4 R |
| 2,076,503 | 4/1937 | Mussey | 105/4 R |
| 3,216,370 | 11/1965 | Kulieke | 105/4 R |
| 3,399,631 | 9/1968 | Weber | 105/4 |
| 3,650,219 | 3/1972 | Seely | 105/4 R |
| 3,687,084 | 8/1972 | O'Leary et al. | 105/4 R |
| 4,191,107 | 3/1980 | Ferris et al. | 105/4 R |

OTHER PUBLICATIONS

Intermodalism Tops $1-Billion, published in Progressive Railroading, Mar. 1978, pp. 59-61.

*Primary Examiner*—Richard A. Bertsch
*Attorney, Agent, or Firm*—Henry W. Cummings

[57] ABSTRACT

An articulated truck center connection of known construction joins extensions extending in opposite directions from the transverse center of adjacent car end portions to the center plate of a truck supporting the adjacent ends of the cars. A pair of side bearings are mounted on the truck bolster on opposite sides of the articulated center connection. Each side bearing includes a rectangular channel or tube mounted on the truck and a first bearing surface which receives a first extension from one adjacent car end. The first extension is free to slide horizontally on the first bearing. The channel or tube extends above the first bearing surface and a second extension from the other adjacent car includes a depending bearing member which rests upon and is supported by the first bearing member. A pivot allows the second car end to rotate vertically about the center connection as the cars transverse vertical inclines. The depending member is free to slide upon the upper surface of the first bearing member as the second car end rotates horizontally relative to the truck.

35 Claims, 10 Drawing Figures

10
12
14
16
22
24
26
28
30
32
34
36
38
C1
C2
44
46
48
60
62
64
66
68
70
72

CONSTANT CONTACT SIDE BEARING FOR ARTICULATED RAIL CARS

REFERENCE TO RELATED APPLICATION

This application is a continuation-in-part of patent application Ser. No. 929,576 filed July 31, 1978, now abandoned.

BACKGROUND OF THE INVENTION

In an article entitled *Articulated Connector*, Railway Locomotives & Cars, March 1969, an articulated connector for use between adjacent container cars supported by a common truck is disclosed. The article does not indicate that side bearings between the respective car ends are utilized.

However, previous side bearing constructions for articulated railway cars utilizing similar articulated connectors have included extensions or arms extending outwardly from opposite ends of the adjacent cars on either side of the articulated connector between the cars, supported by the truck. In one construction the extensions overlap and are vertically spaced. Roller bearings separate the vertically spaced extensions, which allow one car body to pivot relative to the adjacent car body as curves are transversed (CO/BO Whooper hopper car No. 300011). Vertical loads applied to the car body must be transmitted through the adjacent car body before being transmitted to the truck bolster. Since the side bearing assembly is not spring loaded the wear surfaces become concave during continued use resulting in an increase in side bearing clearance.

In another construction, the extensions are laterally spaced and rest upon roller bearings longitudinally spaced on the transverse truck bolster center line (Santa Fe "Six Pack" Car No. ASTF 298999). This arrangement results in an unsymmetrical loading of the truck bolster with respect to the truck bolster transverse centerline between the side frames when the respective side bearing loads from each adjacent car body are not equal or in phase. This unsymmetrical loading condition results in a moment reaction at the center plate connection which is believed to adversely affect the wear characteristics of the car body center plate and truck bolster center plate bowl. Moreover, the truck bolster must be modified by the use of a saddle type structure to support the individual roller bearings on the vertical faces of the truck rather than on the upper surface of the truck as conventionally applied.

One commercially available side bearing normally used on non-articulated cars is mounted on the truck bolster, and includes rubber pads which support a metal pad upon which rest extensions or projections of the car body. However, it is not believed that such side bearings have been used previously on trucks supporting articulated cars.

SUMMARY OF THE INVENTION

An articulated truck center connection of known construction joins extensions extending in opposite directions from the transverse center of adjacent car end portions to the center plate of a truck supporting the adjacent ends of the cars. A pair of side bearings are mounted on the truck bolster on opposite sides of the articulated center connection. Each side bearing includes a rectangular channel or tube mounted on the truck, and a first bearing surface which receives a first extension from one adjacent car end. The first extension is free to slide horizontally on the first bearing. The channel or tube extends above the first bearing surface and a second extension from the other adjacent car includes a depending bearing member which rests upon and is supported by the first bearing member. A pivot allows the second car end to rotate vertically about the center connection as the cars transverse vertical inclines. The depending member is free to slide upon the upper surface of the first bearing member as the second car end rotates horizontally relative to the truck. When the side bearing includes a rectangular tube, the first extension rests upon the lower horizontal portion of the rectangular tube.

THE DRAWINGS

DESCRIPTION OF PREFERRED EMBODIMENTS

Figures 1, 2, 3, 4:
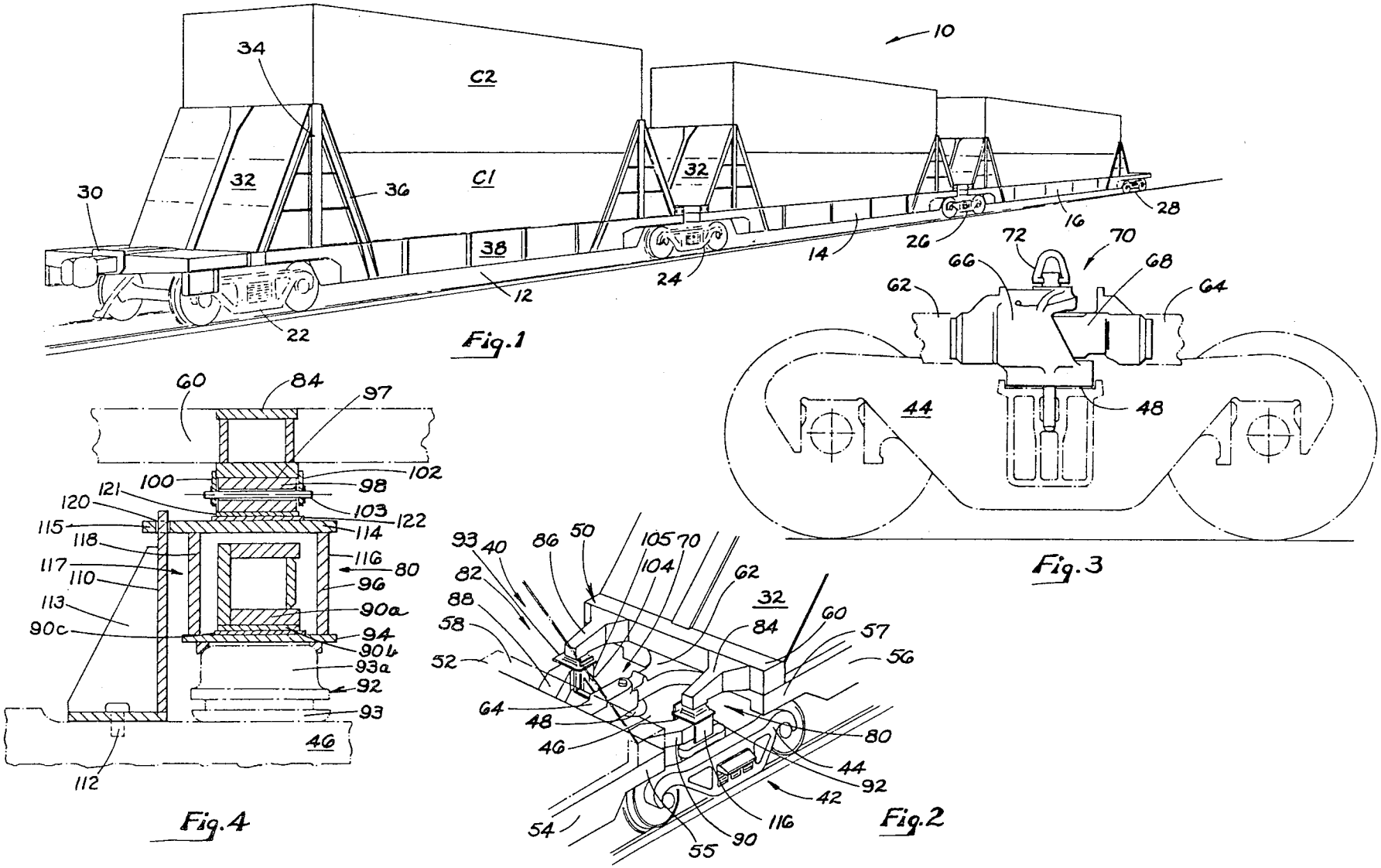
FIG. 1 is a schematic perspective view of a series of articulated container cars utilizing the articulated car constant contact side bearing of the present invention.
FIG. 2 is a schematic perspective view of the articulated constant contact side bearing assembly of the present invention.
FIG. 3 is a vertical sectional view through the articulated connector and truck supporting adjacent cars.
FIG. 4 is a transverse sectional view illustrating the constant contact side bearing arrangement of the present invention.

A series of interconnected container cars are indicated generally at 10 in FIG. 1. This series of cars includes car bodies 12, 14 and 16 supported upon trucks 22, 24, 26 and 28. The car bodies 12, 14 and 16 are preferably constructed according to the teachings of U.S. Pat. No. 4,091,742 granted May 30, 1978, hereby incorporated into the present application by this reference.

Very briefly, an end sill 30 is located above truck 22 and includes an end diagonal 32 entending upwardly to an end bulkhead 34. A pair of stacked containers $C_1$ and $C_2$ are held in place in part by end bulkhead 34 and in part by diagonals 36 extending from end bulkhead 34 on opposite sides of the car to side sills 38. The construction is similar at the other end of the car. In U.S. Pat. No. 4,091,742 a separate truck is located at each end of the car.

The present invention is directed to an arrangement whereby trucks 24, 26 and 28 may support one end of a pair of car bodies; in FIG. 1 one end of car bodies 12, 14 and 16. The articulated arrangement is indicated generally at 40 in FIG. 2. A truck 42 of conventional construction includes side frames 44. A truck bolster 46 and a truck center plate 48 are mounted thereon. A pair of adjacent car ends 50 and 52 each include end sills 54 and 56 having bolster portions 55 and 57. Bolster portions 55 and 57 include articulated end sill supports 58 and 60 welded therto. End diagonals 32 are welded to supports 58 and 60 on the articulated ends of car bodies 12, 14 and 16.

Bolster portions 55 and 57 each include center extensions 62 and 64, FIG. 3. Extension 62 includes a female coupling portion 66, and extension 64 includes a male coupling portion 68 of the articulated connector 70 described in the above-mentioned article hereby incorporated into the present application by this reference, and shown in FIG. 3. An articulated connector pin 72 extends vertically through the femal connecting portion 66 and the male portion 68 and into the truck center plate 48.

A pair of articulated car side bearings 80 and 82 are mounted on either side of the articulated connector 70. The side bearings 80 and 82 are to be used respectively with extensions 84 and 86 extending from articulated support 60 and extensions 88 and 90 from articulated support 58. Since the construction of the side bearing assemblies 80 and 82 is the same, only one will be described in detail.

Figure 6:
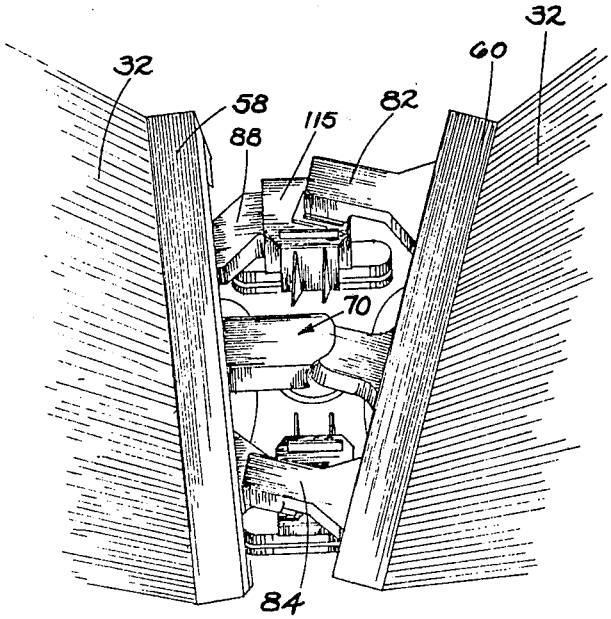
FIG. 6 is a schematic perspective view of the model shown in FIG. 5 in the horizontally fully rotated position.

As shown in FIG. 4, the side bearing assembly 80 includes a SIMPLEX TM side bearing 92 marketed by American Steel Foundries including a pair of rubber springs 93 and 93*a* attached to truck bolster 46 and to pedestal plate 94 of pedestal 96. Pedestal 96 includes a vertical support or guide 110 attached to truck bolster 46 with fasteners 112. Gussets 113 support vertical support 110. A channel 117 includes a pedestal top plate 114 and depending legs 116 and 118 which join plate 94 and support top plate 114. Guide 110 extends through a slot 120 in plate 114 to allow up and down movement of pedestal 96 as rubber springs 93 and 93*a* cushion vertical loads. The outer end 90*a* of a first bearing of first extension 90 is of rectangular cross section and rests upon the upper surface of plate 94, and is free to slide back and forth, and to some degree laterally, as car end 52 moves relative to truck 42 (FIG. 6). Outer end 90*a* includes a lower cover plate 90*b* to which is welded a wear plate 90*c*.

Figure 7:
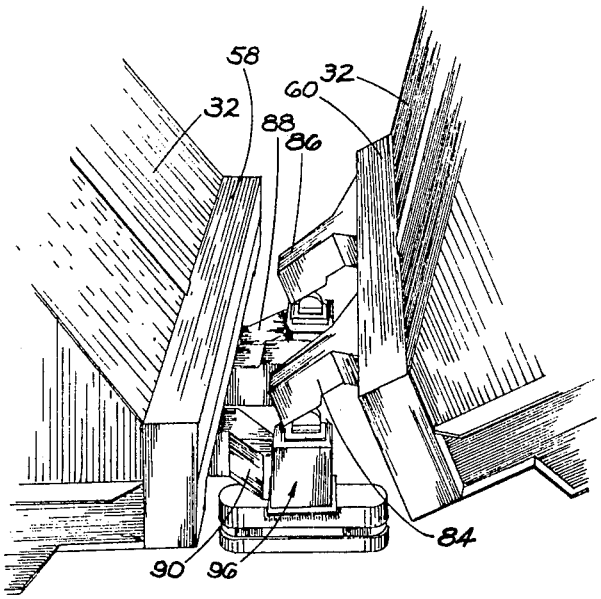
FIG. 7 is a schematic perspective view of the model shown in FIG. 5 in the vertically rotated position.
Figure 5:
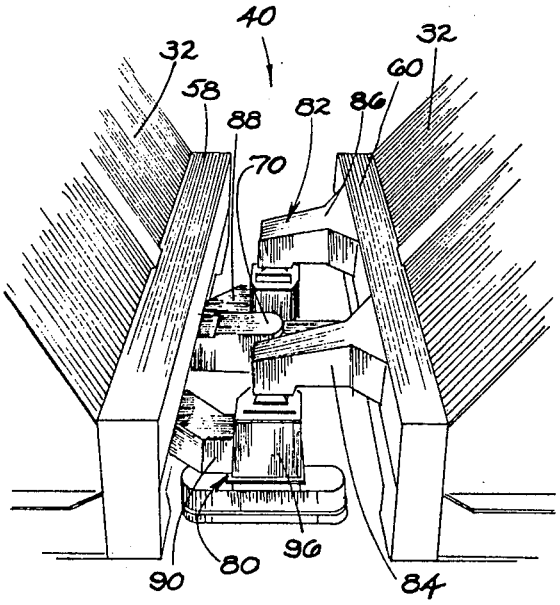
FIG. 5 is a schematic perspective view of a model of the articulated side bearing arrangement of the present invention.

A second extension 84 extending from articulated support 60, includes a semi-circular slot 97 engaging a second semi-circular bearing member 98 which rests upon pedestal 96. Second bearing 98 is free to slide upon pedestal 96 as car end 50 moves relative to truck 42. Bearing 98 includes a lower cover plate 120 welded to a wear plate 122 which slides on pedestal wear surface 115 of top plate 114. A pair of depending keepers 100 and 102 depend from extension 84 to hold semi-circular bearing 98 in place. A pin 103 passes through bearing 98 and keepers 100 and 102. Slot 97 and the cylindrical surface of second bearing member 98 allow car end 52 to pivot up and down about center connection 70 when, for example, inclines are transversed by the cars. See FIG. 7. Additionally, top plate 114 of pedestal 96 provides a second bearing surface 115 upon which cylindrical bearing 98 may slide as car end 52 rotates relative to truck 42 (FIG. 6).

Side bearing 82 is constructed in the same manner as side bearing 80 and includes a wear plate 104 upon which rests a first bearing 88*a* from first extension 88 which is free to move horizontally thereon. A pedestal 105 is welded to wear plate 104, and a second extension 86 includes a slot which houses a semi-circular second bearing similar to second bearing 98.

Cover plates 90*b* and 121 provide preload to insure that in loaded condition, the side bearing assemblies 40 and 42 take the main lading loads, rather then the center connection 70.

Car end 50 can rotate horizontally to a limited extent of approximately ± eight (8) degrees about center connection 70 (FIG. 6). Similarly, car end 52 can rotate in a horizontal plans relative to center connection 70 for an amount of ± eight (8) degrees. Thus, in traversing a curve, a total of sixteen (16) degrees of horizontal movement will be accommodated by the arrangement of the present invention. It is to be noted that extension or projection 84 will abut transverse member 58 if angles in excess of about 16 degrees are encountered in negotiating a clockwise curve in FIG. 6. In negotiating a counter-clockwise curve, projection or extension 84 will abut the other end of extension 58.

It is to be noted that a conventional three (3) piece freight car truck is used. The side bearing design described above does not require a special truck with special features.

The articulated joint has the capability to rotate about a longitudinal centerline parallel to the longitudinal centerline of the car body.

The present invention provides a resilient vertical reaction at the truck bolster for lateral car body moments sharing a common articulated joint without recourse to direct interaction of the car bodies.

Further, in accordance with the present invention, the vertical reactions at the truck bolster are induced along a transverse axis between truck side frames within a nominal deviation so as to be considered symmetrical within the present industry acceptance.

Figure 8:
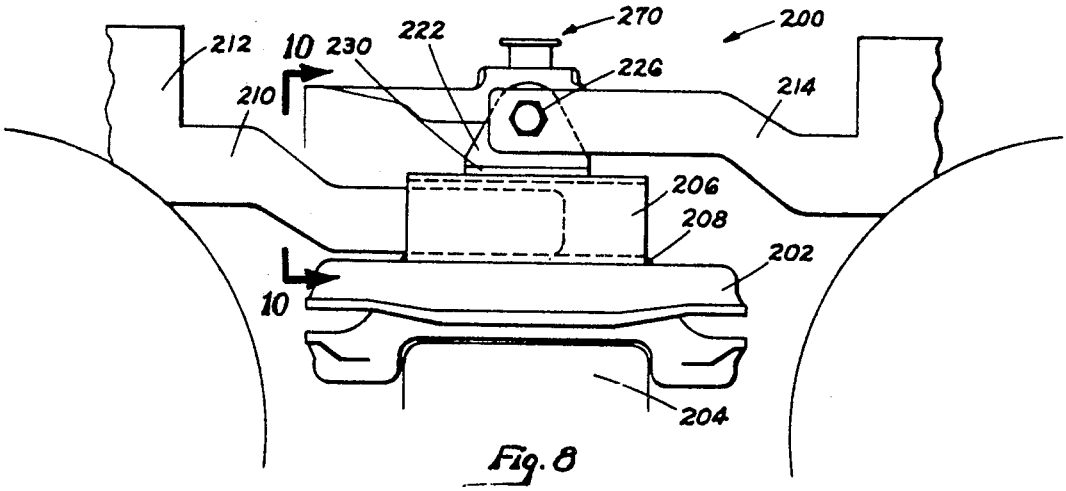
FIG. 8 is a side elevation view of another embodiment of the present invention.
Figure 9:
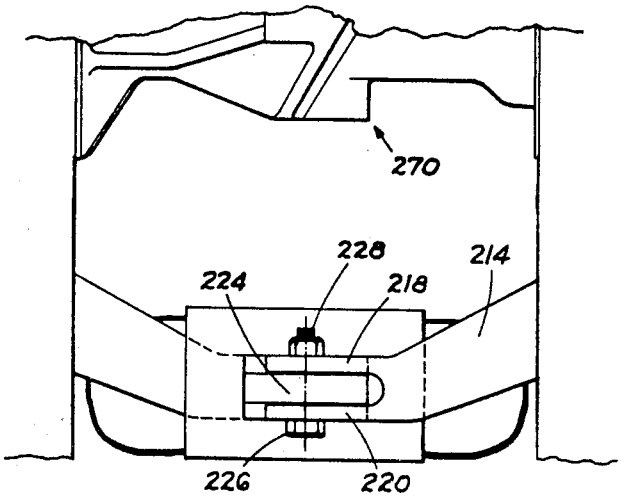
FIG. 9 is a top plan view of the embodiment shown in FIG. 8.
Figure 10:
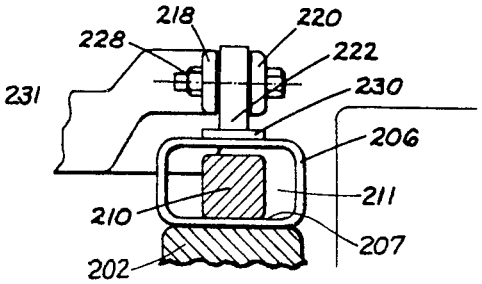
FIG. 10 is an end view of the embodiment shown in FIG. 8 looking in the direction of the arrows along the line 10—10 in FIG. 8.

Another embodiment of the present invention is illustrated in FIGS. 8 through 10. As illustrated in FIGS. 8 and 9, a center connection 270 constructed in the same manner as connection 70 in FIGS. 2 and 3 is also provided. In this embodiment a constant contact side bearing arrangement 200 includes a side bearing 202 similar to side bearing 92 in FIG. 4 mounted upon a truck bolster 204. Mounted upon side bearing 202 is a rectangular tube 206. Rectangular tube 206 is conveniently attached to side bearing 202 by welding as illustrated at 208. Alternatively in this embodiment a channel shaped member of the type shown in FIG. 4 at 117 may be used having a separate plate 94 supported by the side bearing. An extension 210 attached to an adjacent car end 212 extends within rectangular tube 206 and rests upon a first bearing surface 207 as illustrated in FIG. 8. It can be seen from FIG. 10 that sufficient clearance 211 exists between rectangular tube 206 and extension 210 to allow lateral movement of extension 210 relative to rectangular tube 206.

A second extension 214 extends from a car body 216 to a position above rectangular tube 206. As shown in FIGS. 9 and 10, extension 214 is bifurcated and includes a pair of arms 218 and 220. Bearing member 222 is attached to arms 218 and 220 by means of a pin 224 having a head 226 and a threaded nut 228 at the opposite end. A wear plate 230 is located at the lower portion of depending member 222. It will be apparent that bearing member 230 is free to slide upon the upper second bearing surface 231 of rectangular tube 206 as car body 216 and extension 214 pivot horizontally relative to the upper surface of rectangular tube 206 as car body 216 and extension 214 pivot horizontally relative to the upper surface of rectangular tube 206. In addition, extension 214 and car body 216 pivot vertically relative to rectangular tube 206 and side bearing 202 by virtue of pin 224.

It is thus apparent that with this embodiment, extension 210 can pivot laterally relative to rectangular tube 206 or a channel by virtue of the clearance 211 between extension 210 and the rectangular tube or channel. Furthermore, extension 210 can slide longitudinally relative to the tube or channel. Extension 214 can slide longitudinally upon the rectangular tube or channel and can also move laterally relative thereto. In addition, car body 216 and extension 214 can pivot vertically relative to the rectangular tube or channel and car body 212 by virtue of pin 224. It is thus apparent that curves in the track bed and vertical inclines are readily negotiated by the side bearing arrangement shown in FIGS. 8 through 10.

What is claimed is:

1. A side bearing assembly for use on an articulated truck supporting the adjacent ends of a pair of railway cars, each side bearing adapted to be mounted on a truck bolster on opposite sides thereof; each side bearing comprising: a rectangular channel or tube mounted on the truck and having spaced vertical legs; and a first bearing surface located between said vertical legs which receives a first extension from one adjacent car end; said first extension being free to slide horizontally on said first bearing; said channel or tube extending above said first bearing surface and having a second bearing surface thereon, and a second extension from the other adjacent car including a pivoted, depending bearing member which rests upon and is supported by said second bearing surface; said pivot allowing the second car end to rotate vertically about said side bearing as vertical inclines are traversed; said depending member being free to slide horizontally upon said second bearing surface as said second car end rotates horizontally relative to the truck.

2. A side bearing assembly according to claim 1 wherein said vertical legs are spaced from said first extension sufficiently to provide clearance for said first extension to pivot horizontally.

3. A side bearing assembly according to claim 2 wherein said side bearing includes a rectangular tube and wherein said first bearing surface comprises the lower horizontal portion of said rectangular tube.

4. A side bearing assembly according to claim 2 wherein said side bearing includes a channel and said first bearing surface is formed on a member located between said spaced vertical legs.

5. A side bearing assembly according to claim 1 wherein said second extension is bifurcated and includes spaced end portions; said depending member extends between said spaced end portions; and wherein a pin pivotably mounting said depending member extends through said depending member and said spaced end portions.

6. A side bearing assembly according to claim 1 wherein a wear plate is attached to the lower portion of said depending member which wear plate rests upon said second bearing.

7. A side bearing assembly according to claim 1 wherein said side bearing includes at least one spring mounted upon said truck bolster.

8. A side bearing assembly according to claim 5 wherein a wear plate is attached to the lower portion of said depending member which wear plate rests upon said second bearing.

9. A side bearing assembly according to claim 8 wherein spacer plates are provided in said side bearing of sufficient thickness to insure that lading loads are primarily carried by said side bearings rather than said center connection.

10. A side bearing assembly according to claim 9 wherein a first spacer is located on said first extension above said first bearing surface.

11. A side bearing assembly according to claim 10 wherein a second spacer plate is located on said second bearing surface below said second extension.

12. A constant contact side bearing arrangement for articulated rail cars for use with an articulated truck center connection which joins center extensions extending in opposite directions from the center of adjacent bolster ends of adjacent rail cars to the center plate of a truck supporting the ends of the adjacent cars comprising: a pair of side bearings mounted on said truck on opposite sides of the articulated center connection; each side bearing including a first wear plate which receives a first bearing located on a first side extension of a first adjacent car end; said first bearing free to slide horizontally on said first wear plate; a pedestal rigidly connected to said truck and extending above said first wear plate; said pedestal including a second wear surface which receives a second bearing; said second bearing including a curved upper surface; a second side extension extending from a second adjacent car end; said second side extension including a curved contour cooperating with said curved upper surface to enable said second car end to rotate vertically relative to said center connection and said pedestal as the cars traverse vertical inclines; said second bearing being free to slide horizontally upon said second wear surface as said second adjacent car end rotates relative to said truck.

13. A side bearing arrangement according to claim 12 wherein said first wear plate is resiliently mounted upon said truck to aid the arrangement in withstanding vertical shocks.

14. A side bearing arrangement according to claim 13 wherein said pedestal is rigidly connected to said first wear plate.

15. A side bearing arrangement according to claim 13 wherein said pedestal includes a pair of laterally spaced vertical walls which support said second wear surface.

16. A side bearing arrangement according to claim 15 wherein said spaced vertical walls provide clearance for horizontal movement of said first bearing upon said first wear plate.

17. A side bearing arrangement according to claim 12 wherein the inner end of one of said second side extensions is adapted to abut a transverse portion of the adjacent car when the cars have assumed the fully rotated position about said articulated truck center connection.

18. A side bearing arrangement according to claim 12 including keeper means for said second bearing depending from said second side extension.

19. A side bearing arrangement according to claim 12 wherein a first extension wear plate is provided on said first side extension which engages said first wear plate.

20. A side bearing arrangement according to claim 12 wherein a third wear plate is provided on said second bearing which engages said second wear surface.

21. A constant contact side bearing arrangement for articulated rail cars for use with an articulated truck center connection which joins center extensions extending in opposite directions from the center portion of adjacent ends of adjacent rail cars to the center plate of a truck supporting the ends of the adjacent cars comprising: a pair of side bearings mounted on said truck on opposite sides of the articulated center connection; each side bearing including a first wear plate which receives a first bearing located on a first side extension of a first adjacent car end; said first bearing being free to slide horizontally on said first wear plate; a pedestal resiliently mounted on said truck and extending above said first wear plate; said pedestal including a second wear surface which receives a second bearing, a second side extension extending from a second adjacent car end; said second bearing including a curved upper surface and said second side extension including a curved slot cooperating with said curved upper surface to enable said second car end to rock vertically relative to said center connection and said pedestal as the cars traverse vertical inclines; said second bearing being free to slide horizontally upon said second wear surface as said second car end rotates relative to said truck.

22. A side bearing arrangement according to claim 21 wherein the inner end of one of said second side extensions is adapted to abut a transverse portion of said first adjacent car when the cars have assumed the fully rotated position about said articulated truck center connection.

23. A side bearing arrangement according to claim 21 wherein said pedestal includes a pair of laterally spaced vertical walls which support said second wear surface.

24. A side bearing arrangement according to claim 23 wherein said spaced vertical walls provide clearance for horizontal movement of said first bearing upon said first wear plate.

25. A side bearing arrangement according to claim 21 wherein a first extension wear plate is provided on said first side extension which engages said first wear plate.

26. A side bearing arrangement according to claim 21 wherein a third wear plate is provided on said second bearing which engages said second wear surface.

27. A constant contact side bearing arrangement for articulated rail cars comprising: a pair of side bearings mounted on a rail car truck on opposite sides thereof; each side bearing including a first wear plate which receives a first bearing located on a first sides extension of a first adjacent car end; said first bearing being free to slide horizontally on said first wear plate; a pedestal mounted on said truck and extending above said first wear plate; a second side extension extending from a second adjacent car end; second bearing means located on said pedestal and engaging said second extension to enable an adjacent second car end to rock vertically relative to said truck as vertical inclines are traversed; said second bearing means being free to slide horizontally upon said pedestal as said second car end rotates relative to said truck.

28. A side bearing arrangement according to claim 27 wherein said bearing means includes a curved bearing surface which engages a curved surface on said second extension.

29. A side bearing arrangement according to claim 28 wherein said second bearing surface is convex and said second extension surface is concave.

30. A side bearing arrangement according to claim 29 wherein said second extension includes depending keeper means which maintain said second extension in engagement with said second bearing means.

31. A side bearing arrangement according to claim 27 wherein said pedestal comprises a rectangular tube.

32. A constant contact side bearing arrangement for articulated rail cars for use with an articulated truck center connection which joins center extensions extending in opposite directions from adjacent rail cars to a truck supporting the ends of the adjacent cars comprising: a pair of side bearings mounted on said truck on opposite sides of said center connection; each side bearing including a first plate which receives a first side extension of a first adjacent car end; said first extension being free to slide horizontally on said first plate; a pedestal rigidly connected to said truck and extending above said first plate; a second side extension extending from a second adjacent car end to a position above said pedestal; pivot means located between said pedestal and said second extension to enable said second car end to rotate vertically relative to said pedestal as the cars traverse vertical inclines.

33. A constant contact side bearing arrangement according to claim 32 wherein said extension includes a second bearing which is free to slide horizontally upon said pedestal as said second adjacent car end rotates relative to said truck.

34. A constant contact side bearing arrangement according to claim 32 wherein said pivot means include cooperating contours on said pedestal and said second extension.

35. A constant contact side bearing arrangement according to claim 33 wherein said pivot means include means pivotably mounting said second bearing upon said second extension.

* * * * *

UNITED STATES PATENT AND TRADEMARK OFFICE

CERTIFICATE OF CORRECTION

PATENT NO. : 4,315,465

DATED : February 16, 1982

INVENTOR(S) : Eugene J. Cordani and Frederick E. Vorwerk

It is certified that error appears in the above-identified patent and that said Letters Patent are hereby corrected as shown below:

ON THE TITLE PAGE,

In the Title, after "Bearing" please insert --ARRANGEMENT--.

In the Abstract of the Disclosure, line 9, after "truck" please insert --,--.

In the Abstract of the Disclosure, line 17, please change "transverse" to --traverse--.

At the end of the Abstract of the Disclosure, please insert the following --When the side bearing includes a rectangular tube, the first extension rests upon the lower horizontal portion of the rectangular tube--.

In column 1, line 1, after "BEARING" please insert --ARRANGEMENT--.

In column 1, line 12, after "1969" insert -- (copy available in Group 310) --.

UNITED STATES PATENT AND TRADEMARK OFFICE

CERTIFICATE OF CORRECTION

PATENT NO. : 4,315,465

DATED : February 16, 1982

INVENTOR(S) : Eugene J. Cordani and Frederick E. Vorwerk

It is certified that error appears in the above-identified patent and that said Letters Patent are hereby corrected as shown below:

In column 1, line 26, please change "transversed" to --traversed--.

In column 2, line 8, please change "transverse" to --traverse--.

In column 3, line 16, please change "femal" to --female--.

In column 4, line 5, please change "then " to --than--.

In column 3, line 59, please change "transversed" to --traversed--.

Signed and Sealed this

*Twenty-ninth* Day of *March 1983*

[SEAL]

*Attest:*

GERALD J. MOSSINGHOFF

*Attesting Officer*

*Commissioner of Patents and Trademarks*